US011986749B2

(12) United States Patent
Chu

(10) Patent No.: US 11,986,749 B2
(45) Date of Patent: May 21, 2024

(54) IMMERSIVE THEATER SYSTEM

(71) Applicant: PHALANITY DIGITAL TECHNOLOGY CO., LTD., Kaohsiung (TW)

(72) Inventor: Po-Lun Chu, Kaohsiung (TW)

(73) Assignee: PHALANITY Digital Technology Co., Ltd., Kaohsiung (TW)

( * ) Notice: Subject to any disclaimer, the term of this patent is extended or adjusted under 35 U.S.C. 154(b) by 345 days.

(21) Appl. No.: 17/647,895

(22) Filed: Jan. 13, 2022

(65) Prior Publication Data

US 2023/0219013 A1 Jul. 13, 2023

(51) Int. Cl.
*A63J 13/00* (2006.01)
*A63J 25/00* (2009.01)

(52) U.S. Cl.
CPC ..... *A63J 13/00* (2013.01); *A63J 25/00* (2013.01)

(58) Field of Classification Search
CPC .... A63J 5/00; A63J 5/021; A63J 13/00; A63J 25/00; A63G 31/00; A63G 31/12; A63G 31/16; E04B 1/32; E04B 4/00
USPC ..... 472/59–61, 130
See application file for complete search history.

(56) References Cited

U.S. PATENT DOCUMENTS 3,973,839 A * 8/1976 Stumpf ..... G03B 29/00 352/10
5,050,354 A * 9/1991 Vendramini ..... E04B 1/3211 52/80.1
2010/0134695 A1* 6/2010 O'Connell ..... G03B 35/00 348/789
2015/0062537 A1* 3/2015 Kim ..... H04N 9/3182 353/30
2015/0224411 A1* 8/2015 Valtiner-Zuegg ..... G09B 9/00 472/60
2016/0112691 A1* 4/2016 Bert ..... A63J 25/00 359/449
2016/0333597 A1* 11/2016 de Lespinois ..... E04H 3/22
2022/0203249 A1* 6/2022 Green ..... A63G 31/00

* cited by examiner

*Primary Examiner* — Kien T Nguyen
(74) *Attorney, Agent, or Firm* — Rosenberg, Klein & Lee

(57) ABSTRACT

An immersive theater system includes a theater device having a projection room and a displaying screen unit, a multimedia audiovisual assemblage disposed in the projection room, and a central control device connected to the multimedia audiovisual assemblage. The multimedia audiovisual assemblage includes lighting units, speakers and projectors. The projectors are installed at different angles to face different display screens of the displaying screen unit. The central control device includes an audiovisual source coupled to the projectors and the speakers, and the audiovisual source is firstly divided and then displayed on the display screens to create an immersive environment whereby audience members in the projection room feel them to be immersed in lifelike surroundings caused by activating the multimedia audiovisual assemblage under the control of the central control device. The immersive theater system can be disposed in a mobile carrier to increase the mobility and the frequency of use.

6 Claims, 5 Drawing Sheets

IMMERSIVE THEATER SYSTEM

BACKGROUND OF THE INVENTION

1. Field of the Invention

This invention relates to a theater system and relates particularly to an immersive theater system.

2. Description of the Related Art

With the rapid progress of society and social change, the public has a busy and tense life. In order to effectively reduce the pressure of life, different leisure activities are adapted to ease stress. Seeing a movie in a theater is one of the leisure activities that some people will do to reduce the pressure of life. A conventional theater is usually an independent building located in the downtown, or is kept in a large shopping mall to thereby provide a large indoor space, create a great film effect, and meet requirements for entertainment. However, business hours of the theater are restricted to be standard. Movies in the theater are also unchangeable. Thus, the conventional theater may not meet everyone's need. People will go to the theater only when the movie in which they are interested comes out, and that limits the box office revenue generated from movie ticket sales. The theater cannot bring in more customer proactively. When the box office revenue is unfavorable, the costs for movie royalties, area rental, marketing, and operating cannot be recouped. Further, the conventional theater is unable to create an immersive environment and provide immersive experiences. In other words, the theater cannot present the movies by gaining a complete and real sense or by allowing the audience members to feel them to be immersed in lifelike surroundings while the audience members are seeing the movies. Hence, an entertainment effect is reduced, and that requires to be improved.

SUMMARY OF THE INVENTION

The object of this invention is to provide an immersive theater system capable of creating an immersive environment which provides a complete and real sense of an audiovisual source whereby audience members feel them to be immersed in lifelike surroundings.

The immersive theater system comprises a theater device, a multimedia audiovisual assemblage disposed in the theater device, and a central control device connected to the multimedia audiovisual assemblage. The theater device has a floor base where a plurality of audience members stand, a plurality of prefabricated walls surrounding a periphery of the floor base, a ceiling unit connected to the prefabricated walls, and a projection room enclosed by the floor base, the prefabricated walls, and the ceiling unit. An entrance is disposed on one of the prefabricated walls to communicate the projection room with an outside space when the entrance is open. An inner floor surface of the floor base and an inner wall surface of each prefabricated wall face the projection room respectively. A displaying screen unit is connected to the floor base and each prefabricated wall. The displaying screen unit has at least one first display screen disposed on the inner floor surface and at least one second display screen disposed on the inner wall surface of each prefabricated wall. The multimedia audiovisual assemblage has a plurality of projectors, speakers, and lighting units. The projectors are directed at different angles whereby the projectors face the floor base and each prefabricated wall to project images to be shown onto the first display screen and the second display screen. The speakers and the lighting units are spaced from each other. A surrounding audiovisual field thereby is caused in the projection room while activating the multimedia audiovisual assemblage. The lighting units are adapted to execute light changes in the projection room. The central control device has a video player coupled to the projectors and the speakers, a light controller coupled to the lighting units, and a control console coupled to the video player and the light controller for controlling operations of the video player and the light controller. The video player is adapted to present an audiovisual source which contains a sound information and an image information. The video player is controlled by the control console to divide the image information. The divided image information is transmitted to the projectors under the control of the control console and deemed to be the images to be shown. The projectors thereby project the images to be shown onto the first display screen and the second display screen for playing, and synchronously the sound information is transmitted to and played by the speakers under the control of the control console. The light controller has a plurality of light-displaying modes. The lighting units are controlled by the light controller under the control of the control console to execute the light changes according to the light-displaying modes. An immersive environment is created by the surrounding audiovisual field in the projection room when the projectors, the speakers, and the lighting units are activated simultaneously, thereby providing a complete and real sense of the audiovisual source, allowing the audience members to be immersed in the immersive environment, enhancing an immersed sense, and improving a viewing experience.

Preferably, the immersive theater system further comprises a special effects generator which is disposed in the projection room and coupled to the control console. The special effects generator is actuated by the control console to generate special effects in cooperation with the audiovisual source in the projection room.

Preferably, the images to be shown projected onto the first display screen and the second display screen are presented by a three-dimensional (3D) effect when the projectors are directed at different angles.

Preferably, the immersive theater system further comprises a door disposed at the entrance for opening and closing the entrance.

Preferably, the theater device, the multimedia audiovisual assemblage, and the central control device are disposed in a mobile carrier to thereby facilitate a mobile movement of the immersive theater system.

Preferably, the control console includes a time synchronization module coupled to the video player and the light controller.

DETAILED DESCRIPTION OF THE PREFERRED EMBODIMENTS

Figure 1:
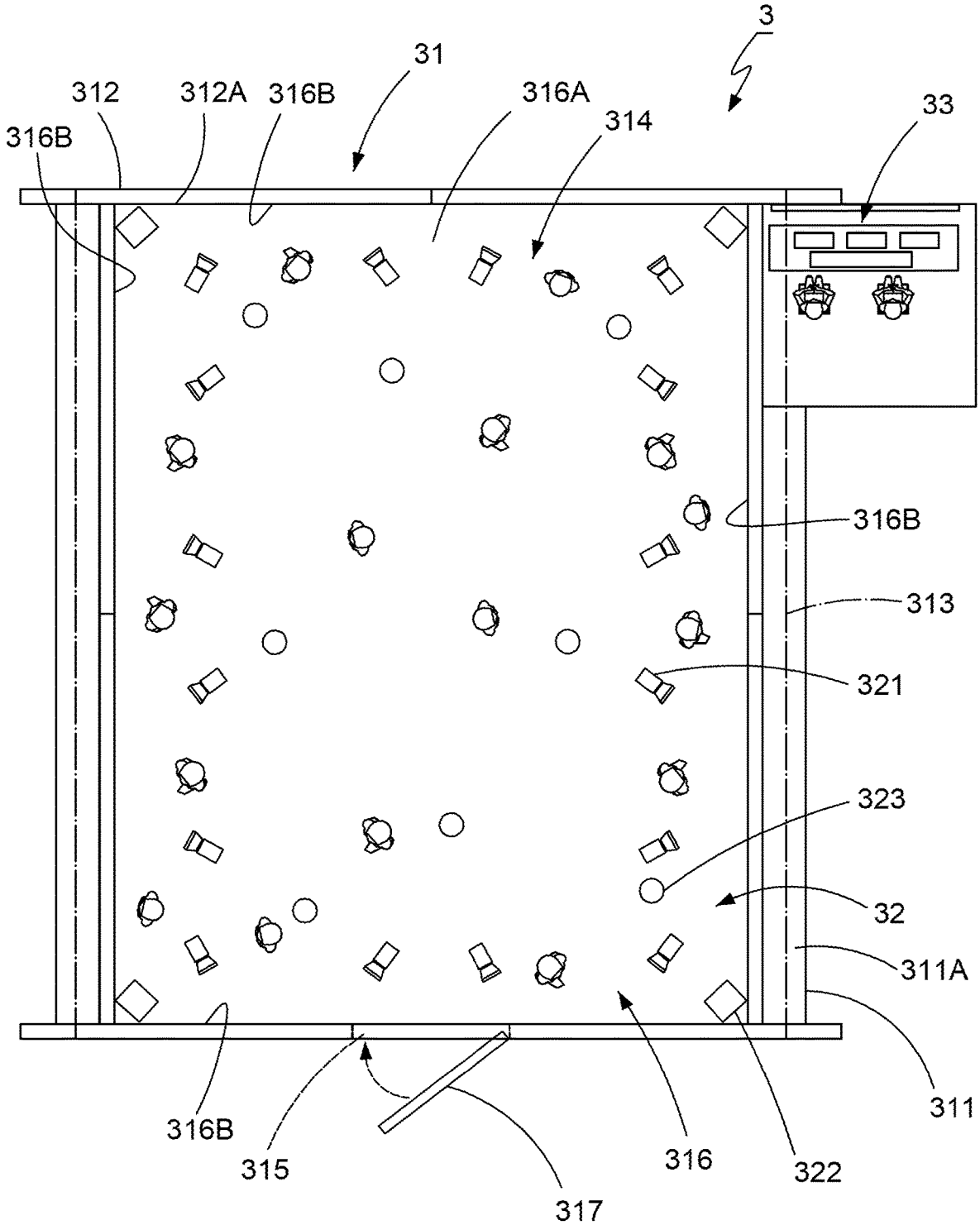
FIG. 1 is a schematic view showing a first preferred embodiment of this invention.
Figure 2:
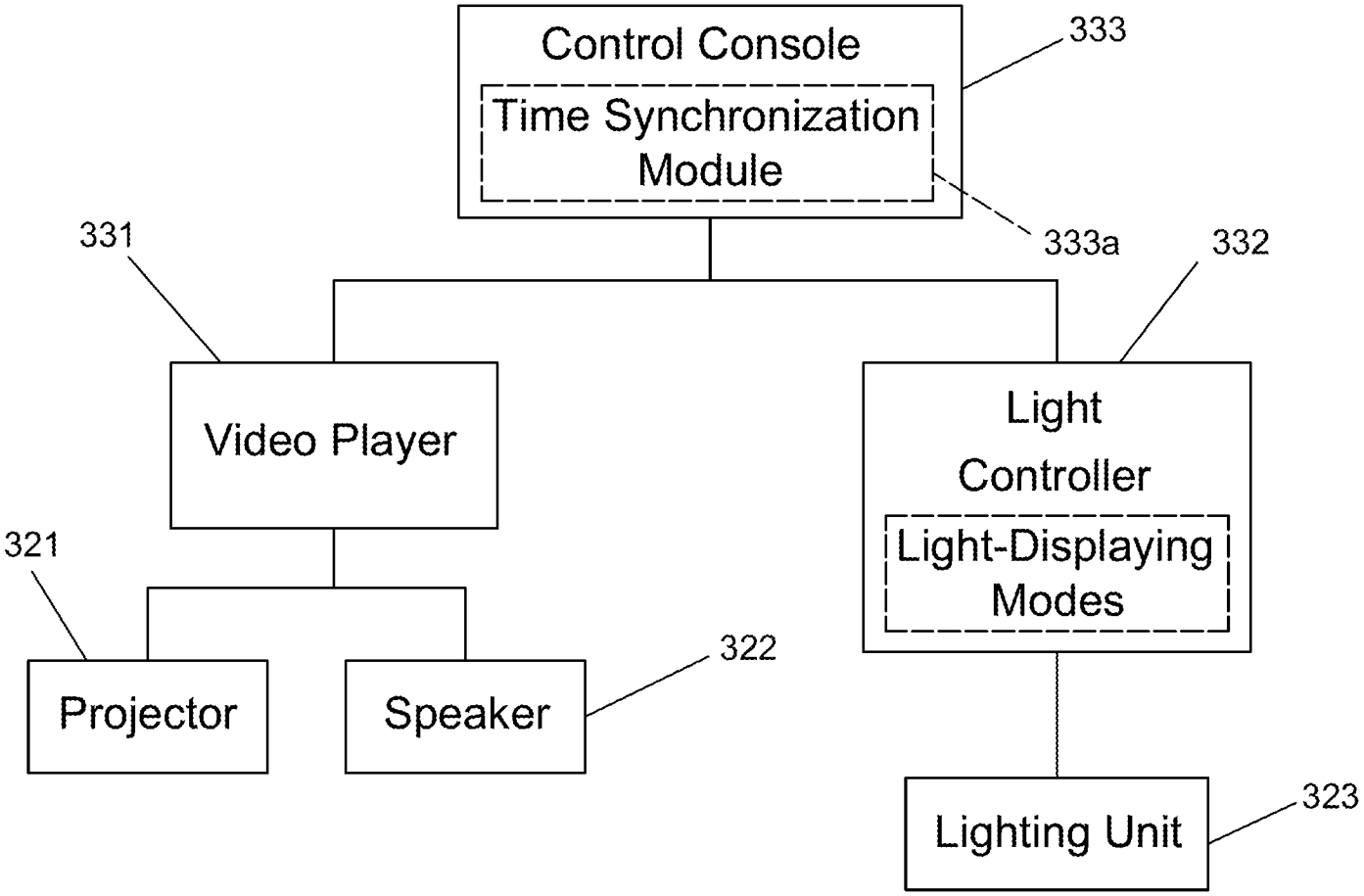
FIG. 2 is a schematic view showing partial elements of the first preferred embodiment of this invention.

Referring to FIG. 1 and FIG. 2, a first preferred embodiment of an immersive theater system 3 is disclosed. The immersive theater system 3 comprises a theater device 31, a multimedia audiovisual assemblage 32 disposed in the theater device 31, and a central control device 33 coupled to the multimedia audiovisual assemblage 32. The central control device 33 is adapted to control the multimedia audiovisual assemblage 32. The theater device 31 has a floor base 311 where a plurality of audience members stand, a plurality of prefabricated walls 312 enclosing a periphery of the floor base 311, a ceiling unit 313 connected to the prefabricated walls 312, and a projection room 314 enclosed by the floor base 311, the prefabricated walls 312, and the ceiling unit 313. The ceiling unit 313 is located opposite to the floor base 311. An entrance 315 is disposed on one of the prefabricated walls 312. The projection room 314 communicates with an outside space though the entrance 315 when the entrance 315 is open. The floor base 311 has an inner floor surface 311A facing the projection room 314. Each prefabricated wall 312 has an inner wall surface 312A facing the projection room 314. A displaying screen unit 316 is connected to the floor base 311 and each prefabricated wall 312. The displaying screen unit 316 has at least one first display screen 316A disposed on the inner floor surface 311A of the floor base 311 and at least one second display screen 316B disposed on the inner wall surface 312A of each prefabricated wall 312. In this preferred embodiment, a door 317 is disposed at the entrance 315 for opening and closing the entrance 315. The projection room 314 can communicate with the outside space only when the door 317 is open.

The multimedia audiovisual assemblage 32 has a plurality of projectors 321, a plurality of speakers 322, and a plurality of lighting units 323. The projectors 321 are headed at different angles whereby the projectors 321 face the floor base 311 and each prefabricated wall 312 to project images to be shown onto the first display screen 316A and the second display screen 316B. The images to be shown projected onto the first display screen 316A and the second display screen 316B are presented by a three-dimensional (3D) effect when the projectors 321 are directed at different angles. The speakers 322 are spaced from each other and located along the periphery of the floor base 311 to allow the audience members who stand in the projection room 314 to be surrounded by the speakers 322. The lighting units 323 are also spaced from each other. A surrounding audiovisual field thereby is caused in the projection room 314 while activating the multimedia audiovisual assemblage 32. The lighting units 323 are adapted to execute light changes in the projection room 314.

The central control device 33 has a video player 331 coupled to the projectors 321 and the speakers 322, a light controller 332 coupled to the lighting units 323, and a control console 333 coupled to the video player 331 and the light controller 332 for controlling an operation of the video player 331 and an operation of the light controller 332. The video player 331 is adapted to present an audiovisual source which contains a sound information and an image information. The control console 333 can control the video player 331 to divide the image information into a plurality of image layers. After the image layers are transmitted to the projectors 321 under the control of the control console 333, the image layers are projected through different projectors 321 respectively and integrated into the images to be shown. The images to be shown are then projected onto the first display screen 316A and the second display screen 316B. Synchronously, the sound information is transmitted to and played by the speakers 322 under the control of the control console 333. The light controller 332 has a plurality of light-displaying modes. The lighting units 323 are actuated by the light controller 332 under the control of the control console 333 to execute the light changes according to the light-displaying modes. Thus, an immersive environment is created by the surrounding audiovisual field in the projection room 314 when the projectors 321, the speakers 322, and the lighting units 323 operate together to thereby provides a complete and real sense of the audiovisual source and allow the audience members to be immersed in the immersive environment. The light controller 332 also can control the lighting units 323 to warn the audience members of the danger. Further, the light controller 332 can be controlled by the control console 333 or controlled manually through a control panel (not shown) to thereby meet different control needs. In this preferred embodiment, the control console 333 has a time synchronization module 333*a* which is adapted to help actuate the video player 331 and the light controller 332 simultaneously for achieving a simultaneous operation of the projectors 321, the speakers 322, and the lighting units 323.

Referring to FIGS. 1 and 2, after the immersive theater system 3 is built on a spacious place, the first display screen 316A disposed on the inner floor surface 311A of the floor base 311 is provided with a plurality of positioning marks (not shown) so that the audience members can stand on the positioning marks to thereby prevent the audience members from crowding together and improve a projection effect. Based on the selected audiovisual source, the projectors 321 are installed in the projection room 314 to face the first display screen 316A and the second display screen 316B at different angles so as to enhance the projection effect. The speakers 322 and the lighting units 323 are spaced from, each other and disposed along the periphery of the projection room 314 to thereby enclose the audience members in the projection room 314. The lighting units 323 can be directed at different angles to face the first display screen 316A and the second display screen 316B differently according to the selected audiovisual source. The central control device 33 is then coupled to the multimedia audiovisual assemblage 32 for controlling operations of the projectors 321, the speakers 322, and the lighting units 323. Thus, it does not cost much time to built and fabricate the immersive theater system 3.

The audience members enter the projection room 314 through the entrance 315 when the door 317 is open. Operations of checking tickets or counting the number of the entered audience members can be executed at the entrance 315. After the audience members enter into the projection room 314 and stand on the positioning marks respectively, the entrance 315 is close by closing the door 317 to thereby break the communication of the projection room, 314 and the outside space. After that, the light controller 332 is adapted to turn off the lighting units 323 under the control of the control console 333 to thereby make the projection room 314 become dim. Meanwhile, emergency lights (not shown) can be kept for guiding directions in case an emergency happens. The control console 333 then controls the video player 331 to divide the image information of the selected audiovisual source into different image layers. The sound information of the audiovisual source can be also divided into different sound layers according to needs. The image layers are transmitted to the projectors 321 and the sound information is transmitted to the speakers 322 under the control of the control console 333. The time synchronization module 333*a* actuates the video player 331 and the light controller 332 simultaneously to further achieve the simultaneous operation of the projectors 321, the speakers 322, and the lighting units 323 whereby the surrounding audiovisual field is caused in the projection room 314. After the image layers are transmitted to the projectors 321 respectively, the image layers are overlapped and integrated into the images to be shown when the projectors 321 play the image layers. The images to be are then projected onto the first display screen 316A and the second display screen 316B by the three-dimensional (3D) effect. Simultaneously, the sound information is played by the speakers 322 and the lighting units 323 execute the light changes according to the light-displaying modes synchronously under the control of the control console 333. Hence, the immersive environment is created by the surrounding audiovisual field in the projection room 314 while the projectors 321, the speakers 322, and the lighting units 323 are activated together to thereby allow the audience members to be immersed in the immersive environment and present the audiovisual source excellently. Further, the audience members are surrounded by the images to be shown in the projection room 314 to thereby provide a 360 degrees video panorama and increase an immersed sense. Therefore, the simultaneous operation of the projectors 321, the speakers 322, and the lighting units 323 can create the immersive environment and provide a complete and real sense of the audiovisual source. Because the immersive theater system 3 can be fabricated anywhere, people in remote areas can also enjoy the immersed sense of the immersive environment through the immersive theater system 3.

Figure 3:
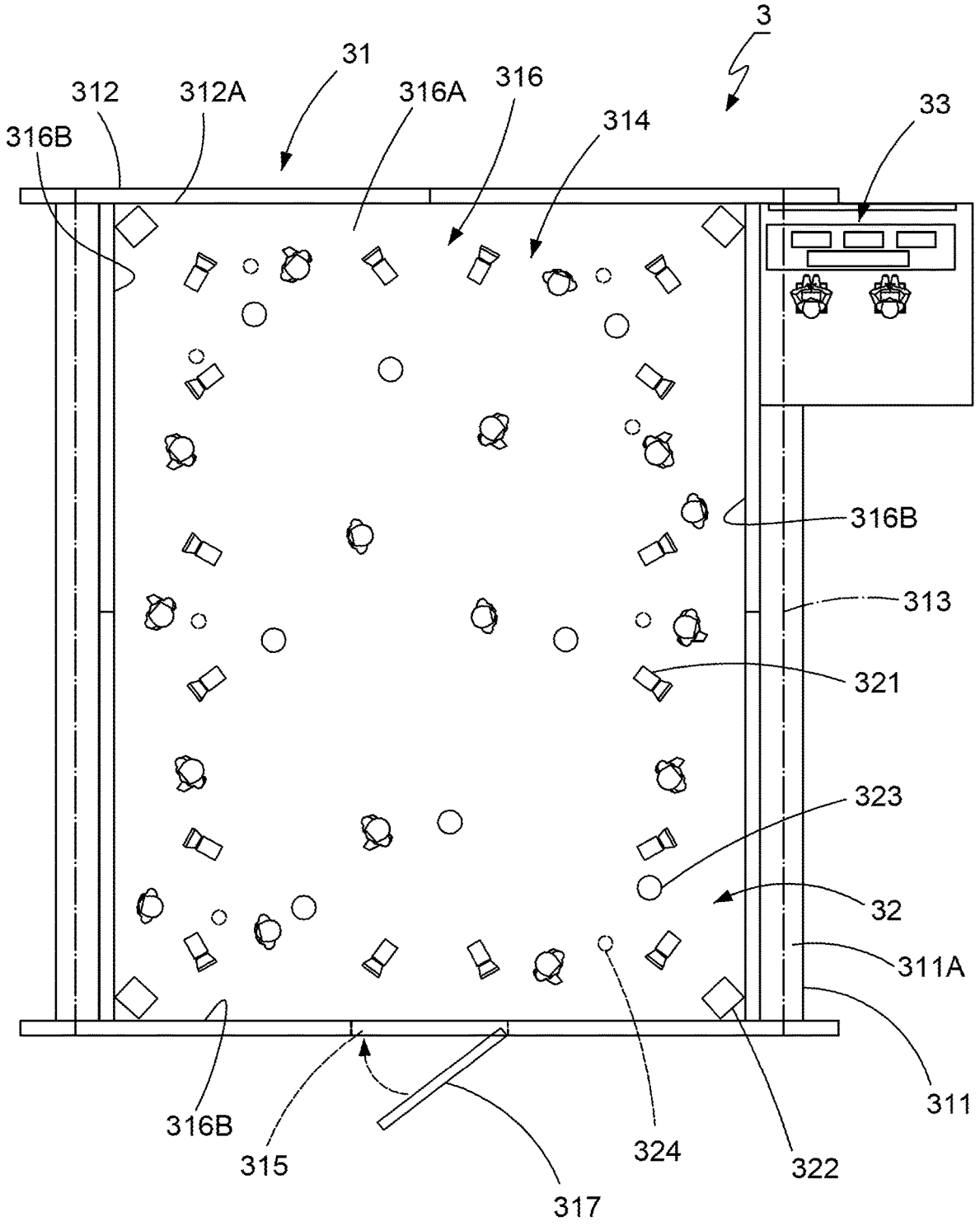
FIG. 3 is a schematic view showing a second preferred embodiment of this invention.
Figure 4:
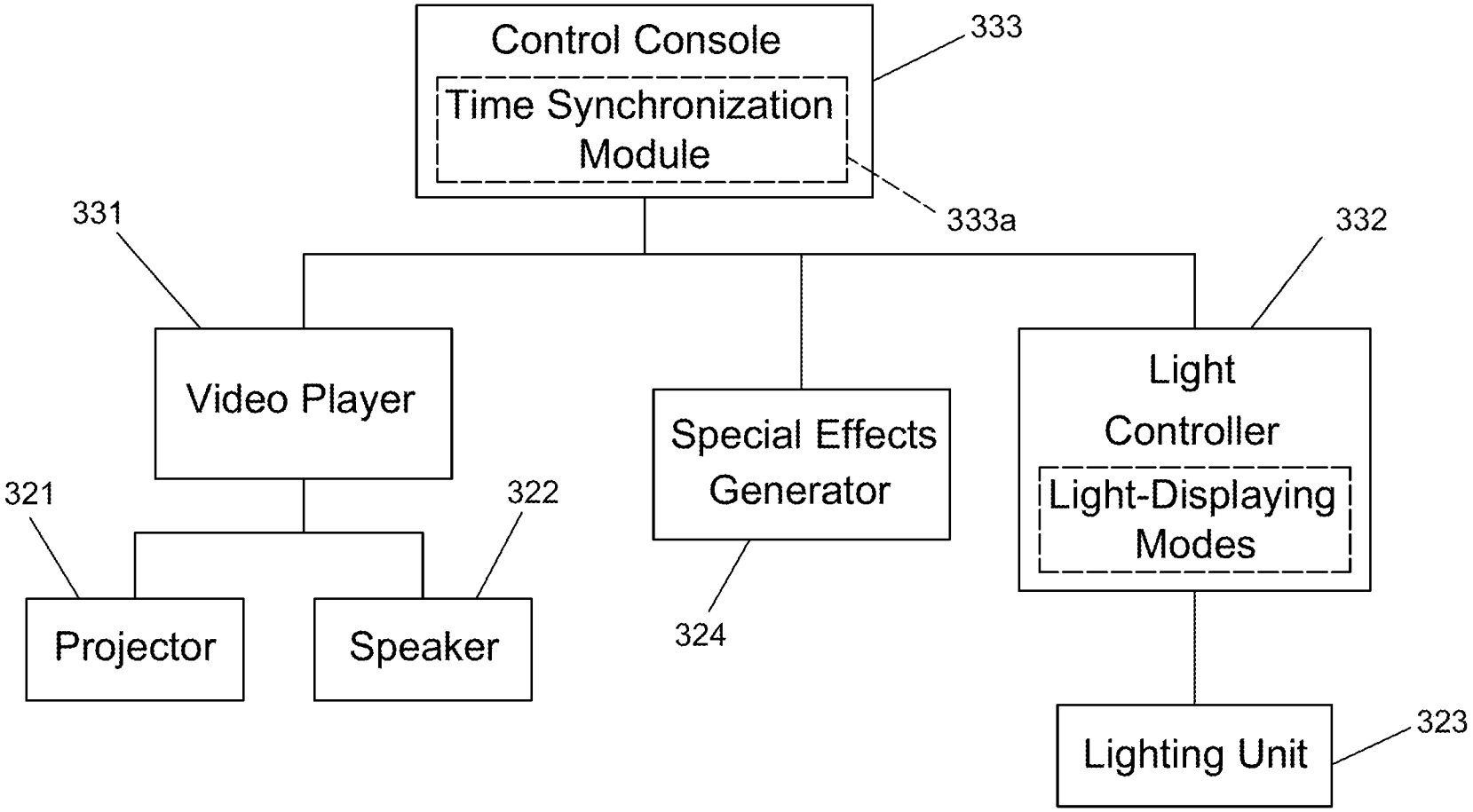
FIG. 4 is a schematic view showing partial elements of the second preferred embodiment of this invention.

Referring to FIGS. 3 and 4 show a second preferred embodiment of the immersive theater system 3 of this invention. The correlated elements and the concatenation of elements, the operation and objectives of the second preferred embodiment are the same as those of the first preferred embodiment. This embodiment is characterized in that a special effects generator 324 is disposed in the projection room 314 and coupled to the control console 333. The special effects generator 324 can be positioned between the projectors 321 or along the periphery of the projection room 314 according to needs. The special effects generator 324 is actuated by the control console 333 to generate special effects such as wind, smell, or mist in the projection room 314 in cooperation with the audiovisual source to thereby enhance the real sense of the audiovisual source. Hence, the special effects generated by the special effects generator 324 allows the audiovisual source to be presented by a four dimensional (4D) effect to thereby enhance the immersed sense, increase the richness of the audiovisual source, improve an entrainment effect, and attract the audience members effectively.

Figure 5:
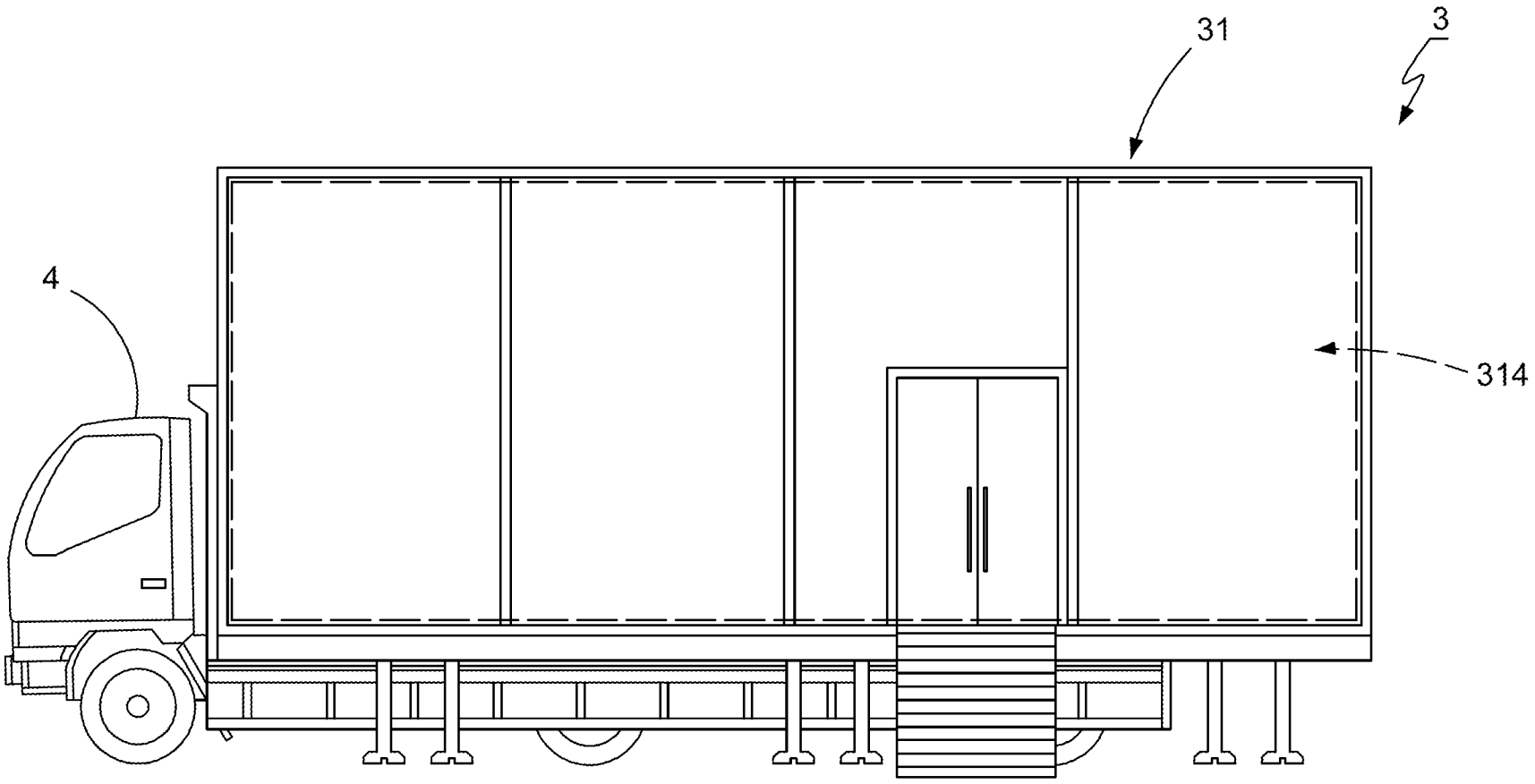
FIG. 5 is a schematic view showing a third preferred embodiment of this invention.

Referring to FIG. 5 shows a third preferred embodiment of the immersive theater system 3 of this invention. The correlated elements and the concatenation of elements, the operation and objectives of the third preferred embodiment are the same as those of the first preferred embodiment. This embodiment is characterized in that the theater device 31, the multimedia audiovisual assemblage 32, and the central control device 33 are disposed in a mobile carrier 4. After the mobile carrier 4 stops at a proper location, the fabrication of the immersive theater system 3 can be executed to thereby facilitate a mobile movement of the immersive theater system 3, attract more audience members, recoup the cost for purchasing the audiovisual source, and save the operating cost.

To sum up, the immersive theater system, of this invention takes advantages that the projection room can be built quickly to accommodate a plurality of audience members. The projectors, the speakers, and the lighting units that surround the projection room are activated simultaneously to present an audiovisual source after the audiovisual source is processed to thereby create an immersive environment whereby the audience members in the projection room feel them to be immersed in lifelike surroundings, provide a complete and real sense of the audiovisual source, and increase the immersed sense. Further, the immersive theater system can be disposed on a mobile carrier to thereby increase the mobility and the frequency of use.

While the embodiments of this invention are shown and described, it is understood that further variations and modifications may be made without departing from the scope of this invention.

What is claimed is:

1. An immersive theater system comprising:

a theater device including a floor base where a plurality of audience members stand, a plurality of prefabricated walls surrounding a periphery of said floor base, a ceiling unit connected to said plurality of prefabricated walls, and a projection room enclosed by said floor base, said plurality of prefabricated walls, and said ceiling unit, wherein an entrance is disposed on one of said plurality of prefabricated walls, said projection room communicating with an outside space when said entrance is open, said floor base having an inner floor surface facing said projection room, each of said plurality of prefabricated walls having an inner wall surface facing said projection room, a displaying screen unit being connected to said floor base and each of said plurality of prefabricated walls, said displaying screen unit including at least one first display screen disposed on said inner floor surface and at least one second display screen disposed on said inner wall surface of each of said plurality of prefabricated walls;

a multimedia audiovisual assemblage disposed in said projection room, said multimedia audiovisual assemblage including a plurality of projectors directed at different angles whereby said plurality of projectors face said floor base and each of said prefabricated walls to project images to be shown onto said at least one first display screen and said at least one second display screen, said multimedia audiovisual assemblage further including a plurality of speakers spaced from each other and a plurality of lighting units spaced from each other, a surrounding audiovisual field thereby being caused in said projection room while activating said multimedia audiovisual assemblage, said plurality of lighting units being adapted to execute light changes in said projection room; and a central control device including a video player coupled to said plurality of projectors and said plurality of speakers, alight controller coupled to said plurality of lighting units, and a control console coupled to said video player and said light controller for controlling an operation of said video player and an operation of said light controller, said video player being adapted to present an audiovisual source which contains a sound information and an image information, said video player being controlled by said control console to thereby divide said image information, said divided image information being transmitted to said plurality of projectors under the control of said control console and deemed to be said images to be shown, said plurality of projectors thereby projecting said images to be shown onto said at least one first display screen and said at least one second display screen for playing, and synchronously said sound information being transmitted to and played by said plurality of speakers under the control of said control console, said light controller including a plurality of light-displaying modes, with said plurality of lighting units actuated by said light controller under the control of said control console to execute said light changes according to said light-displaying modes, an immersive environment being created by said surrounding audiovisual field in said projection room when said plurality of projectors, said plurality of speakers, and said plurality of lighting units are activated together, thereby allowing said plurality of audience members to be immersed in said immersive environment.

2. The immersive theater system according to claim 1, further comprising a special effects generator, said special effects generator being disposed in said projection room and coupled to said control console, said special effects generator being actuated by said control console to generate special effects in cooperation with said audiovisual source in said projection room.

3. The immersive theater system according to claim 1, wherein said images to be shown projected onto said at least one first display screen and said at least one second display screen are presented by a three-dimensional (3D) effect when said plurality of projectors are directed at different angles.

4. The immersive theater system according to claim 1, further comprising a door disposed at said entrance to open and close said entrance.

5. The immersive theater system according to claim 1, wherein said theater device, said multimedia audiovisual assemblage, and said central control device are disposed in a mobile carrier to thereby facilitate a mobile movement of said immersive theater system.

6. The immersive theater system according to claim 1, wherein said control console includes a time synchronization module coupled to said video player and said light controller.

* * * * *